US008287003B2

(12) United States Patent
Grotkowski et al.

(10) Patent No.: US 8,287,003 B2
(45) Date of Patent: Oct. 16, 2012

(54) LOTTERY TICKET WITH A REGISTERED HOLOGRAPHIC LAYER

(75) Inventors: Dion Grotkowski, Pinckney, MI (US); Scott Stalker, Dexter, MI (US); Derek LaRose, Belleville, MI (US); Lyle Scrymgeour, Oakbank (CA)

(73) Assignee: Pollard Banknote Limited Partnership, Winnipeg, MB (CA)

( * ) Notice: Subject to any disclaimer, the term of this patent is extended or adjusted under 35 U.S.C. 154(b) by 587 days.

(21) Appl. No.: 12/473,563

(22) Filed: May 28, 2009

(65) Prior Publication Data

US 2009/0298567 A1 Dec. 3, 2009

Related U.S. Application Data

(60) Provisional application No. 61/057,908, filed on Jun. 2, 2008.

(51) Int. Cl.
*G09G 5/00* (2006.01)

(52) U.S. Cl. ..... 283/72; 283/101

(58) Field of Classification Search ..... 283/101, 283/903, 91, 72

See application file for complete search history.

(56) References Cited

U.S. PATENT DOCUMENTS

| | | | | |
|---|---|---|---|---|
| 5,037,101 | A * | 8/1991 | McNulty | 273/139 |
| 5,585,144 | A * | 12/1996 | Waitts | 427/258 |
| 5,681,065 | A * | 10/1997 | Rua et al. | 283/95 |
| 6,809,864 | B2 * | 10/2004 | Martynov et al. | 359/576 |
| 7,455,323 | B2 * | 11/2008 | Taylor et al. | 283/101 |
| 2004/0150220 | A1 * | 8/2004 | Holmes et al. | 283/110 |
| 2005/0179253 | A1 * | 8/2005 | Rivera et al. | 283/81 |
| 2005/0230960 | A1 * | 10/2005 | Bilodeau et al. | 283/75 |
| 2006/0006639 | A1 | 1/2006 | Taylor et al. | |
| 2007/0164559 | A1 * | 7/2007 | Kozdras | 283/100 |
| 2007/0215262 | A1 * | 9/2007 | Taylor et al. | 156/64 |
| 2008/0110972 | A1 * | 5/2008 | Grossman et al. | 235/375 |
| 2010/0218693 | A1 * | 9/2010 | Kozdras | 101/450.1 |
| 2011/0109949 | A1 * | 5/2011 | Hazen | 359/22 |

FOREIGN PATENT DOCUMENTS

CA 2471024 11/2005

* cited by examiner

*Primary Examiner* — Casandra Davis
(74) *Attorney, Agent, or Firm* — Adrian D. Battison; Ade & Company Inc

(57) ABSTRACT

A lottery ticket having a substrate layer with game data printed in a game area and an opaque scratch-off layer applied over game area is modified by the addition of an patterned holographic metallized layer applied over the substrate which has different patterns for a series of the tickets and which is arranged to have an appearance associated with game information printed over the metallized. The printing is carried out by optically analyzing the patterns and longitudinally registering the material printed onto the metallized with the pattern in the metallized.

13 Claims, 3 Drawing Sheets

LOTTERY TICKET WITH A REGISTERED HOLOGRAPHIC LAYER

This application claims the benefit under 35 U.S.C. 119 of Provisional Application 61/057,908 filed Jun. 2, 2008.

The present invention relates generally to the field of game or lottery tickets which include a scratch-off layer covering game indicia which can be exposed by the player removing the layer for playing of the game or lottery.

The game provided on each substrate sheet may be for prizes both monetary and product related or may be merely for entertainment where no gambling or prize is involved. The type and value of any prizes can vary widely. The games may be pre-determined, otherwise known as "instant win" tickets or may include elements of skill or chance.

The games concerned are preferably instant win type games where the result is entirely predetermined, since such games are generally preferred in a lottery situation in order to ensure that the total winnings is predetermined. However the present invention is not limited to the type of game to be played and can include probability or other games which include game indicia to be exposed.

The construction may also be used in situations where the main objective is for other purposes than gambling such as in promotional games or games of fun for children or others where no gambling or prizes are involved.

Many such tickets are used directly in a lottery situation so that the tickets have no other relevance other than the playing of the lottery or game by which the player may win monetary or other prizes as part of the lottery or gaming situation. However attention has been recently given to other uses of such tickets such as promotional items used by manufacturers of other products to enhance the sale of the product, or as part of packaging or in other situations where the substrate acts in another capacity and the lottery ticket aspect is merely one part of its function.

The marketing of lottery tickets is primarily based on the psychology of impulse buying so that the ticket itself must be inherently attractive to the potential customer sufficiently to trigger the sale. Particular attention therefore is applied to generating attractive graphics and an attractive appearance of the game face of the ticket.

For this reason high quality graphics and full four colour printing are used in the printing of the product.

Tickets of this type primarily utilize scratch-off technology for covering the game data which can be removed to expose the game data for playing the game. Techniques for applying the scratch-off coating in a manner which provides the necessary protection and security for the game data have become well established. On top of the scratch-off coating it is common to print additional graphics, often in four colour printing for the purposes of providing the required attractive appearance of the ticket.

It is also known that metallized coatings can be applied to products to provide a reflective appearance which yet further enhances the attractiveness and eye-appeal of the product concerned. Lottery tickets have, been manufactured which have a metallized or reflective appearance on the ticket. Such tickets have been manufactured by utilizing a substrate which is formed with a metallized or reflective layer. Commonly a very thin film of aluminum is deposited on a clear film using a metalizing process which uses molten aluminum vapours to make the deposit. The printing is then applied to the metallized layer with the printing including the necessary coatings for defining the game area, applying the game indicia and for covering the game indicia with a secure scratch-off coating. The printing onto a metallized or metallized laminated substrate has used an arrangement in which the game data is either printed directly onto the metallized layer or more preferably onto a lily pad, typically white in color, in the game area so that the ticket retains a metallic appearance in the game area due to this technique. The improvement in attractiveness carries a significant additional expense of utilizing the reflective or holographic substrate. Thus such tickets printed onto holographic substrates carry a very high cost and thus are limited to high end products or special events such as Christmas tickets.

Reflective substrates of this type can be embossed with areas of a particular reflective angle so that the surface appears to change as the angle of viewing varies across the surface. This technique is commonly known as "holographic" and is used on many products to define a surface which is highly attractive to the eye.

The manufacturer of instant win lottery tickets requires a high level of sophistication to ensure the proper levels of security. The ticket must be immune to attack by various techniques including high levels of reflected or transmitted light, attempts to lift or perforate the scratch off coating, chemical or liquid attacks, all of which are designed to expose the game data without removing the scratch-off coating in a manner which indicates that the ticket has been played. Many such lottery tickets have high prize values so that the incentive to breach the security is very high. Certain laboratories have therefore been established to attempt to breach the security of all lottery tickets with only those that pass the rigorous testing being acceptable for sale to the marketplace.

Yet further it is necessary for lottery tickets to have a shelf life of up to two years without degradation of the product leading to the security being breached or the scratch-off coating being difficult to remove.

In order therefore to manufacture an acceptable ticket it is necessary to provide all of the above features.

Thus tickets have been manufactured using holographic stock. These tickets were printed onto a previously laminated stock which featured a holographic image adhered to a card-stock backer. The holographic stock is then overprinted with the end result that the design is seen only in those areas in which there is no ink applied or a coloured version could be seen where a transparent or translucent coloured ink is applied over top.

The disadvantage is that, with this particular method, only a single, random pattern in the holographic image can be used and the tickets are simply printed on top of this random image with no possibility to register the ticket to design contained on the holograph itself. Thus the expensive holographic stock is used to only small advantage in that the same image is located all over the ticket and on all tickets.

In Published US Application 2006/0006639 which corresponds to Canadian application 2,471,024 filed in 2004 by the present Assignees, Pollard discloses the concept of applying a metallized layer over top of the scratch-off or non-scratch-off areas on an instant lottery ticket. A metallic or holographic image is applied over portions of the surface of the ticket either during the printing process or after each of the printing steps is complete. This has been a significant enhancement over the previous method but still requires the use of a random pattern holographic image and there is no ability to register a particular pattern to a specific ticket.

SUMMARY OF THE INVENTION

It is one object of the present invention therefore to provide an improved lottery ticket having a metallized holographic appearance.

According to one aspect of the invention there is provided a book of lottery tickets comprising:

a plurality of lottery tickets, each ticket comprising:

a ticket substrate having a front surface;

a metallized layer at least partly covering the front surface;

the metallized layer being embossed to provide a holographic pattern thereon;

a game area defined on the metallized layer;

indicia defining game data printed on the ticket substrate in the game area;

the game data being covered in a manner such that the game data is arranged to be exposed by a player;

game information printed on the metallized layer of the ticket substrate;

each ticket having the holographic pattern in the metallized layer thereon registered in location with respect to the game information printed thereon;

and at least one of the tickets having the registered holographic pattern thereon different from the registered holographic pattern on another one of the tickets.

Preferably the tickets are of the scratch-off type as defined below but also the same concept may be applied to break-open tickets when printed with variable image printing.

According to a second aspect of the invention there is provided a book of lottery tickets of the scratch-off type comprising:

a plurality of lottery tickets, each ticket comprising:

a ticket substrate having a front surface;

a metallized layer at least partly covering the front surface, the metallized layer being embossed to provide a holographic pattern thereon;

a game area defined on the metallized layer;

indicia defining game data printed over the metallized layer in the game area;

at least one fixing layer applied over the game data in the game area which is arranged to prevent release of the printed game data from the substrate layer;

at least one opaque scratch-off layer applied over the fixing layer, the scratch-off layer being arranged such that it separates from the fixing layer and breaks down into fragments when scratched by a player;

game information printed on the metallized layer of the ticket substrate;

each ticket having the holographic pattern in the metallized layer thereon registered in location with respect to the game information printed thereon;

and at least one of the tickets having the registered holographic pattern thereon different from the registered holographic pattern on another one of the tickets.

Preferably the book contains a plurality of tickets having the registered holographic pattern thereon different from the registered holographic pattern of others of the tickets.

Preferably the plurality of tickets, which have the registered holographic pattern thereon different from the registered holographic pattern of others of the tickets, are arranged in consecutive row. That is, the substrate is provided with a row of different holographic images and the subsequent printing of the game data and game information is registered with respective ones of the patterns.

Preferably the game information, which is printed on said at least one of the tickets having the registered holographic pattern thereon different from the registered holographic pattern on another one of the tickets, is different from the game information printed said another one of the tickets.

Preferably the game information printed on said at least one of the tickets is associated with the pattern in the metallized on said at least one of the tickets in order to provide tickets which are visually very attractive due to the interaction between the holographic pattern and the image printed on the same ticket.

In this way many different tickets can be printed for example to provide a set of different tickets all relating to a theme.

Preferably the ticket substrate comprises a card stock with the metallized layer applied over a front surface of the card stock.

Preferably the metallized layer covers the whole of the ticket substrate.

Preferably the ticket has a printed layer over the scratch-off layer which is also associated with the pattern on the metallized thereon.

According to a third aspect of the invention there is provided a method of manufacturing a book of lottery tickets as defined above comprising:

supplying a ticket substrate in a continuous strip having a front surface with a metallized layer applied over the front surface;

the metallized layer being embossed to provide a series of different holographic patterns in a row thereon;

and subsequently printing onto the embossed metallized layer the game data, game information and scratch-off;

wherein the printing is repeatedly registered along the strip by optically analyzing the patterns to determine a predetermined longitudinal location thereon.

Preferably the length of each different pattern is equal to the length of each ticket.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
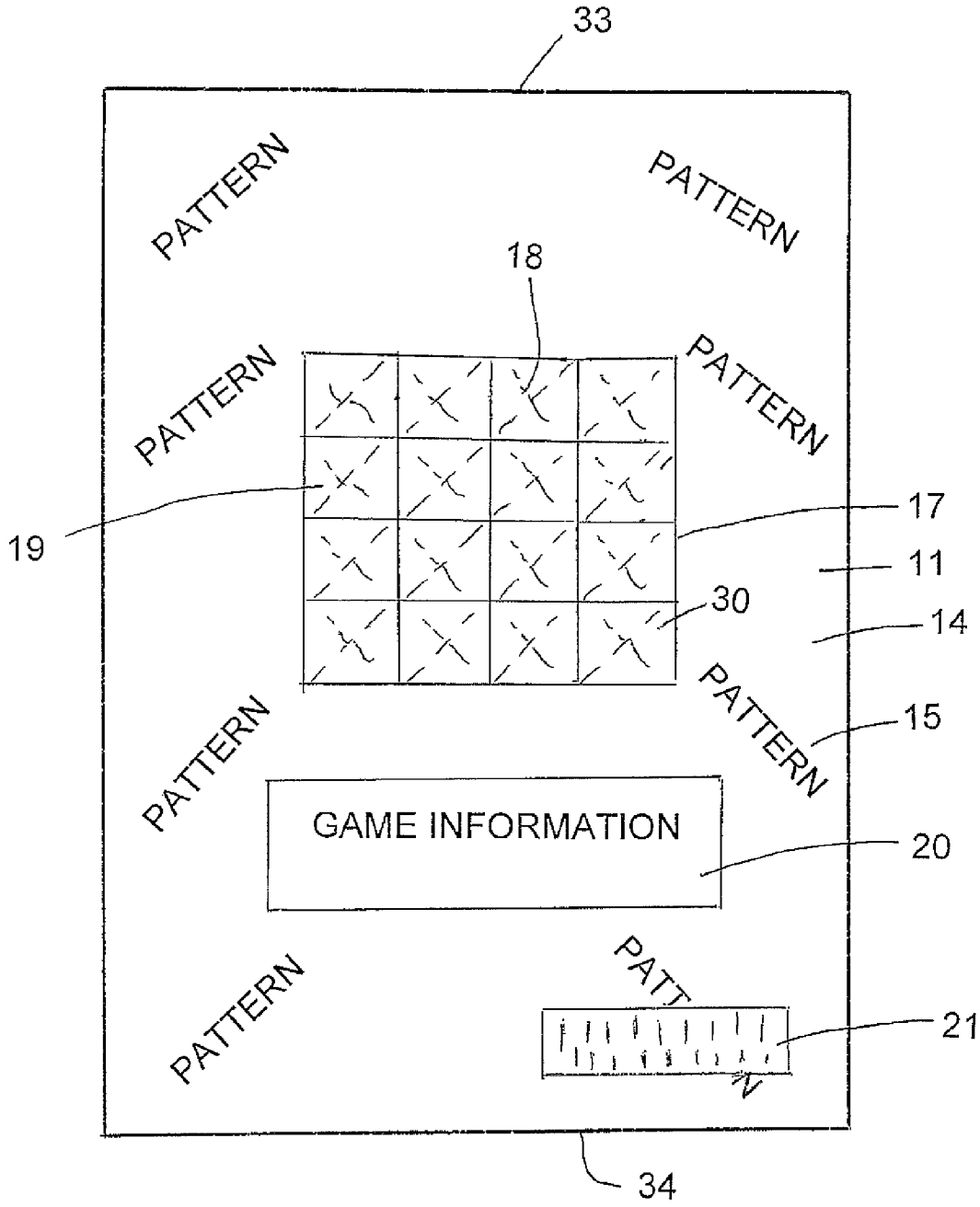
FIG. 1 is a front elevational view of a ticket according to the present invention.
Figure 2:
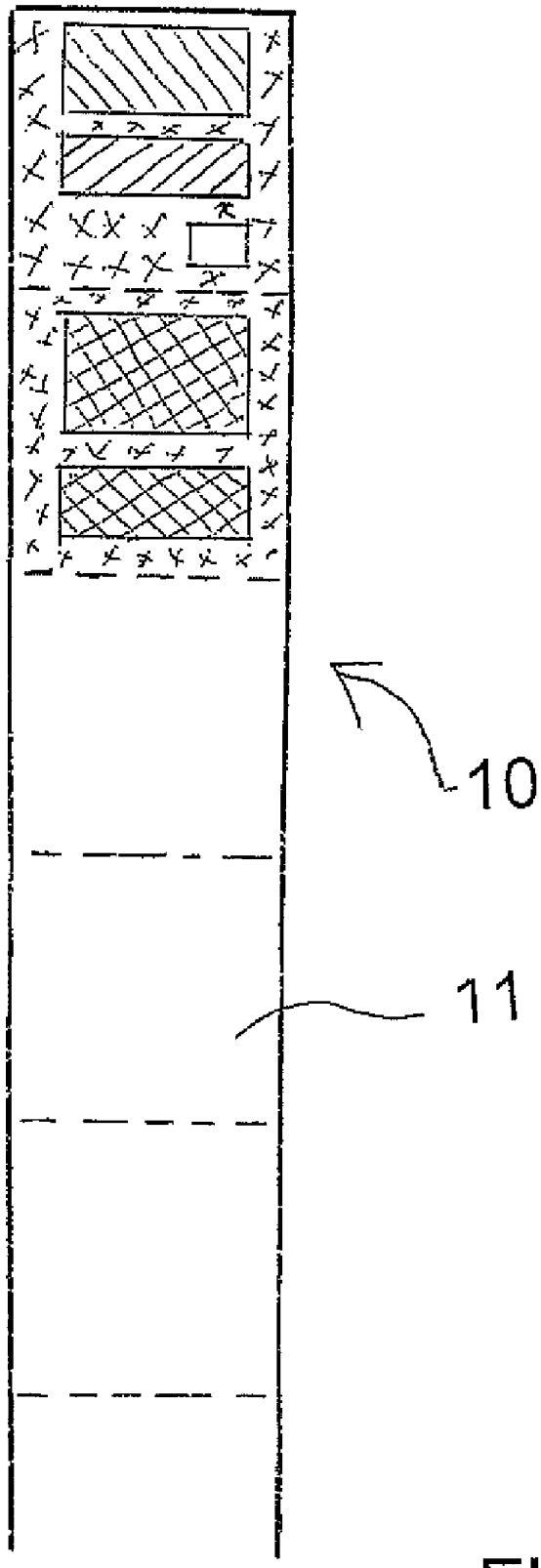
FIG. 2 is a front elevational view of a row of tickets according to the present invention for forming into a book of tickets.
Figure 3:
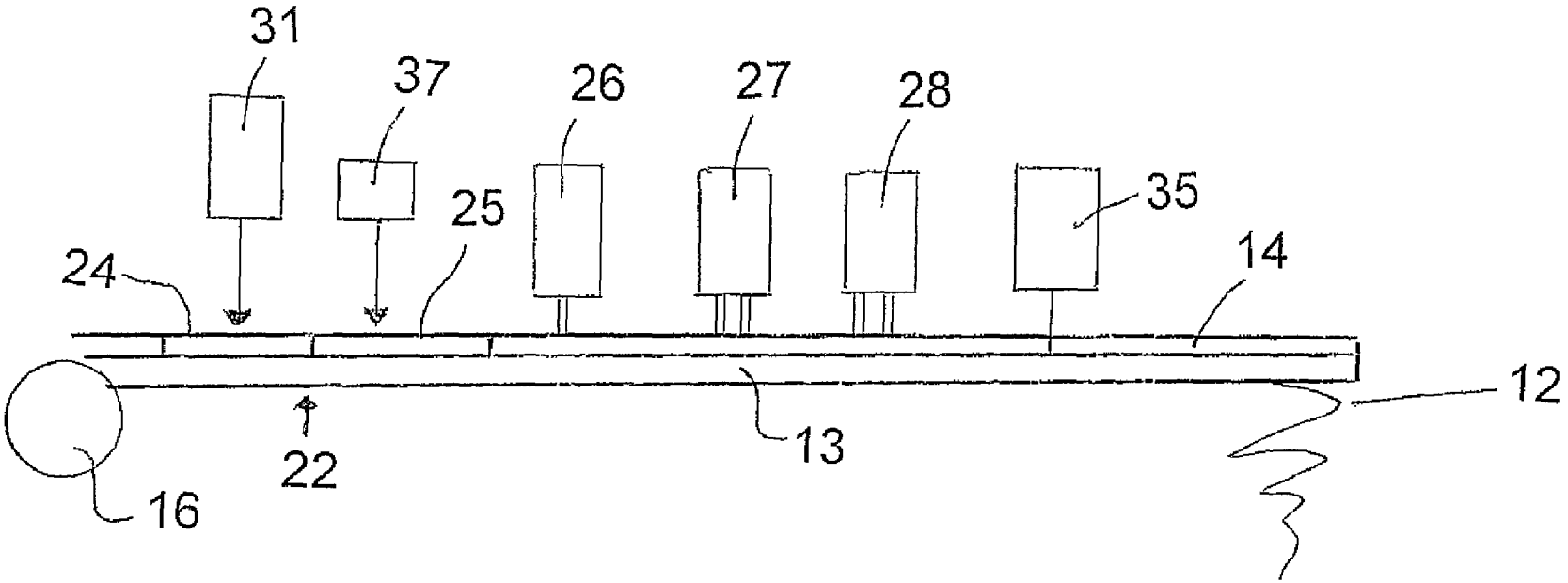
FIG. 3 is a schematic side elevational view of a method of manufacturing the tickets of FIGS. 1 and 2.

A book 10 of lottery tickets 11 includes a plurality of the lottery tickets 11 in a row which are commonly fan folded as shown at 12 to form the book 10 defined by a selected number of the tickets.

Each ticket is formed from a ticket substrate of a card stock 13 on which is applied a metallized layer 14 at least partly covering the front surface.

The metallized layer 14 is embossed to provide a holographic pattern 15 in the metallized. This is carried out by a separate process in the manufacture of the card stock. The embossment is carried out on the metallized and the metallized is laminated to the card stock and supplied to the printer in a roll 16.

On the metallized is printed a game area 17 defined on the metallized layer and indicia defining game data 18 is printed over the metallized layer in the game area either directly on to the metallized or more usually onto a white lily pad printed onto the metallized and formed from a series of security layers well known in the art.

At least one fixing layer is applied over the game data in the game area which is arranged to prevent release of the printed game data from the substrate layer and at least one opaque scratch-off layer 19 is applied over the fixing layer, the scratch-off layer being arranged such that it separates from the fixing layer and breaks down into fragments when scratched by a player.

In addition to the game data in the game area, the ticket has printed onto the front face over the metallized various game information 20 and a bar code or security code 21.

During the printing, the ticket substrate 22 is supplied in a continuous strip having a front surface with a metallized layer applied over the front surface with the metallized layer being embossed to provide a series of different holographic patterns 24, 25 etc in a row thereon. The various materials identified above are printed onto the embossed metallized layer the using printing systems 26, 27, 27 which provide variable image printing commonly using ink jet processes in single color or multicolour processes. During the printing process the printing is repeatedly registered along the strip by optically analyzing the patterns at a reader 31 to determine a predetermined longitudinal location thereon so that each ticket has the holographic pattern in the metallized layer thereon registered in location with respect to the game information printed thereon. Because the patterns 24, 25 etc are different, one or more of the tickets has the registered holographic pattern thereon different from the registered holographic pattern on other ones of the tickets, The different holographic patterns are arranged in a consecutive row where the row is repeated for example every by twelve patterns. This can be formed conventionally by an embossing roller having the patterns arranged in a row around the roller.

The game information 20 also is different from the game information printed said another one of the tickets and is associated with the pattern 15 in the metallized on the ticket.

The ticket also has a printed layer 30 over the scratch-off layer which is associated with the pattern 15 on the metallized thereon.

The length of the tickets between ends 33 and 34 formed by a die cutter 35 is the same as the length of the patterns 24, 25 etc.

This arrangement therefore provides a method which enables the printing of tickets on holographic images which are specifically linked to the ticket design. For example if the manufacturer is running a ticket which features graphics based on the 12 signs of the Zodiac then the holographic stock can feature 12 different images, each one a different Zodiac image. Further the system provides the ability to register the ticket design (for example Aries) to the matching symbol in the holograph. Similarly tickets such as the Twelve Days of Christmas could feature the same concept. In order to be able to achieve this enhanced graphic ability, there is provided means to register the previously embossed holographic design to the ticket graphics. Normally re-registration is done by using printed marks which are subsequently read by a scanner and then the position of the printing press is modified to match the register of the previously printed marked. However when the holographic image is being embossed there is generally no corresponding printed mark (usually black on white) from which to gain a positional reference. The optical analysis provides one possible way for the system to determine the precise location of a particular holographic image on the web and to then apply a mark at a marker 37 which can be subsequently read by the printing equipment. This can be done at the printing press as shown or in another example the film manufacturer supplies the film with a printing mark for re-registration purposes.

The concept is not limited to the examples given above and there are many different applications which can be envisioned. For example a gaming theme could be developed with slot machines, Roulette wheels, etc. and the ticket graphics for each style of game can be matched to the holographic image.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A book of lottery tickets comprising:

a plurality of lottery tickets, each ticket comprising:

a ticket substrate having a front surface;

a metalized layer at least partly covering the front surface;

the metalized layer being embossed to provide a holographic pattern thereon;

a game area defined on the metalized layer;

indicia defining game data printed on the ticket substrate in the game area;

the game data being covered in a manner such that the game data is arranged to be exposed by a player;

game information printed on the metalized layer of the ticket substrate;

each ticket having the holographic pattern in the metalized layer thereon registered in location with respect to the game information printed thereon;

wherein the book contains a plurality of tickets having the registered holographic pattern thereon different from the registered holographic pattern of others of the tickets.

2. The book of lottery tickets according to claim 1 wherein the plurality of tickets, which have the registered holographic pattern thereon different from the registered holographic pattern of others of the tickets, are arranged in consecutive row.

3. The book of lottery tickets according to claim 1 wherein the game information, which is printed on said at least one of the tickets having the registered holographic pattern thereon different from the registered holographic pattern on another one of the tickets, is different from the game information printed said another one of the tickets.

4. The book of lottery tickets according to claim 3 wherein the game information printed on said at least one of the tickets is associated with the pattern in the metalized on said at least one of the tickets.

5. The book of lottery tickets according to claim 1 wherein the ticket substrate comprises a card stock with the metalized layer applied over a front surface of the card stock.

6. The book of lottery tickets according to claim 1 wherein the metalized layer covers the whole of the of ticket substrate.

7. A book of lottery tickets comprising:

a plurality of lottery tickets, each ticket comprising:

a ticket substrate having a front surface;

a metalized layer at least partly covering the front surface;

the metalized layer being embossed to provide a holographic pattern thereon;

a game area defined on the metalized layer;

indicia defining game data printed over the metalized layer in the game area;

at least one fixing layer applied over the game data in the game area which is arranged to prevent release of the printed game data from the substrate layer;

at least one opaque scratch-off layer applied over the fixing layer, the scratch-off layer being arranged such that it separates from the fixing layer and breaks down into fragments when scratched by a player;

game information printed on the metalized layer of the ticket substrate;

each ticket having the holographic pattern in the metalized layer thereon registered in location with respect to the game information printed thereon;

wherein the book contains a plurality of tickets having the registered holographic pattern thereon different from the registered holographic pattern of others of the tickets.

8. The book of lottery tickets according to claim 7 wherein the plurality of tickets, which have the registered holographic pattern thereon different from the registered holographic pattern of others of the tickets, are arranged in consecutive row.

9. The book of lottery tickets according to claim 7 wherein the game information, which is printed on said at least one of the tickets having the registered holographic pattern thereon different from the registered holographic pattern on another one of the tickets, is different from the game information printed said another one of the tickets.

10. The book of lottery tickets according to claim 9 wherein the game information printed on said at least one of the tickets is associated with the pattern in the metalized on said at least one of the tickets.

11. The book of lottery tickets according to claim 7 wherein the ticket substrate comprises a card stock with the metalized layer applied over a front surface of the card stock.

12. The book of lottery tickets according to claim 7 wherein the metalized layer covers the whole of the of ticket substrate.

13. The book of lottery tickets according to claim 7 wherein said at least one of the tickets has a printed layer over the scratch-off layer which is associated with the pattern on the metalized thereon.

* * * * *